US010953297B2

(12) United States Patent
Love

(10) Patent No.: US 10,953,297 B2
(45) Date of Patent: Mar. 23, 2021

(54) ROPING DUMMY HOP MECHANISM

(71) Applicant: PRO EQUINE GROUP, INC., Deerfield, IL (US)

(72) Inventor: Joshua Love, Loveland, CO (US)

(73) Assignee: PRO EQUINE GROUP, INC., Deerfield, IL (US)

( * ) Notice: Subject to any disclaimer, the term of this patent is extended or adjusted under 35 U.S.C. 154(b) by 0 days.

(21) Appl. No.: 15/927,576

(22) Filed: Mar. 21, 2018

(65) Prior Publication Data

US 2018/0272216 A1 Sep. 27, 2018

Related U.S. Application Data

(60) Provisional application No. 62/474,245, filed on Mar. 21, 2017.

(51) Int. Cl.

| | |
|---|---|
| ***A63B 69/00*** | (2006.01) |
| ***A63B 21/00*** | (2006.01) |
| ***A63B 21/005*** | (2006.01) |

(52) U.S. Cl.

CPC ..... *A63B 69/0068* (2013.01); *A63B 21/0058* (2013.01); *A63B 21/156* (2013.01); *A63B 2225/093* (2013.01)

(58) Field of Classification Search

CPC ..... A63B 69/0068
USPC ..... 273/339, 370
See application file for complete search history.

(56) References Cited

U.S. PATENT DOCUMENTS

| | | | | |
|---|---|---|---|---|
| 3,776,553 | A | 12/1973 | Kelton | |
| 3,802,706 | A * | 4/1974 | Hamm | A01K 15/02 273/339 |
| 3,947,033 | A | 3/1976 | Bennett | |
| 4,136,874 | A | 1/1979 | McCord | |
| 4,266,779 | A | 5/1981 | English | |
| 4,286,788 | A | 9/1981 | Simington et al. | |
| 4,451,045 | A | 5/1984 | Fesmire | |
| 4,640,515 | A | 2/1987 | Rhine | |
| 4,662,642 | A | 5/1987 | Archibald et al. | |
| 4,874,179 | A | 10/1989 | Henderson | |
| 4,960,076 | A | 10/1990 | Snorgrass et al. | |
| 4,981,302 | A | 1/1991 | Narramore | |
| 4,995,618 | A | 2/1991 | Panzner | |
| 5,009,432 | A | 4/1991 | Richard | |
| 5,080,373 | A | 1/1992 | Jones | |
| 5,286,032 | A * | 2/1994 | Spencer | A63B 69/0068 273/339 |
| 5,709,386 | A * | 1/1998 | Nelson | A63B 69/0068 273/338 |
| 2016/0310812 | A1 * | 10/2016 | Carrasco | A63B 71/0036 |

* cited by examiner

*Primary Examiner* — John E Simms, Jr.
*Assistant Examiner* — Rayshun K Peng
(74) *Attorney, Agent, or Firm* — K&L Gates LLP

(57) ABSTRACT

An apparatus for use in roping skills training and practice provides a practical, effective, lightweight, and economical alternative to using live animals for heeling practice, which involves the roping of the hind legs of the animal. This apparatus includes a simulated animal torso and a pair of simulated hind legs. The apparatus includes a support frame and a drive system. The drive system includes mechanical links that provide interconnection between the pair of simulated hind legs and the drive system, thus providing for lifelike and coordinated leg and torso movement.

20 Claims, 15 Drawing Sheets

ROPING DUMMY HOP MECHANISM

PRIORITY CLAIM

This application claims priority to U.S. Provisional Patent Application No. 62/474,245 filed Mar. 21, 2017, entitled "IMPROVED ROPING DUMMY HOP MECHANISM," the entire contents of which are incorporated herein by reference.

BACKGROUND

Interest in animal roping skill development, and in animal roping competition generally, has steadily increased since the days when these skills were crucial to cattle ranching operations. Moreover, leg roping skills continue to be important for bull handling, calf branding, and other cattle ranching activities. Because of the anatomical mechanics of cattle, roping the hind legs, often referred to as "heeling," requires split second timing and is considerably difficult. Therefore, it is crucial for those responsible for roping the hind legs of cattle to have the opportunity to engage in repetitive practice.

One of the inherent difficulties in developing roping skills, particularly for hind leg roping, has been historical reliance on live animals and an elaborate practice facility. Often, the repetitive practice of roping skills on live animals is not practical or humane, due to the cumulative stress imposed on the animals. Furthermore, obtaining and maintaining a collection of livestock and a practice facility is very costly. Therefore, there has long been a need for alternative means for practice and training.

A number of different kinds of apparatuses have been developed through the years to assist in the training of heelers, those who rope the hind legs of the animal, as well as headers, those who rope the head of the animal. The simplest such apparatus is a stationary practice dummy that allows a trainee to practice basic roping skills while standing on the ground or sitting on a horse. While this apparatus provides for training opportunities at a minimal cost, it is of limited value in developing the necessary timing skills for successful roping of a moving animal. There have been a number of more advanced devices developed to assist in training of heelers, each simulating the leg movement of a running steer or calf, with varying degrees of effectiveness, complexity, and cost.

Perhaps the best previously-known apparatus for simulating both leg movement and torso movement is disclosed by Nelson in U.S. Pat. No. 5,709,386 ("the '386 Patent"), a U.S. Patent assigned to the assignee of the instant application. The '386 Patent includes a drive mechanism with a drive pulley, drive shaft, and drive cams. The mechanical orientation of these components leads to a particular leg and torso movement. More specifically, as the legs translate forward (i.e., from an extended position behind the torso to a bent position underneath the torso), the torso translates upward.

SUMMARY

One object of the present disclosure is to provide a roping training device that more closely simulates the anatomy of a running steer or calf, through leg and torso movement that is different from those disclosed in the prior art. More specifically, in this alternate leg and torso movement, as the legs translate forward (i.e., from an extended position behind the torso to a bent position underneath the torso), the torso translates downward. This alternate leg and torso movement is a more realistic simulation of anatomical movement than was previously achievable, such as previous simulations implementing the '386 Patent's mechanism. Simulating this alternate leg and torso movement requires a specific mechanical orientation. No known devices simulate this alternate leg and torso movement.

A further object of the present disclosure is to provide a roping training device that allows for ready adjustment in the speed of leg and torso movement, thereby simulating an animal running at varying speeds. A still further object of the present disclosure is to provide a roping training device that is lighter in weight in comparison to prior art devices. A still further object of the present disclosure is to provide a roping training device that is substantially lower in cost than prior art devices. A still further object of the present disclosure is to provide a roping training device with a simple frame structure which incorporates a thin shell as part of the structure. A still further objective of the present disclosure is to provide a roping training device that can be towed behind a motorized vehicle, such as a pickup truck or an all-terrain vehicle. A still further objective of the present disclosure is to provide a roping training device that is easy and economical to maintain, has replacement parts which are economical and readily obtainable, and can ordinarily be serviced and maintained by the user. A still further objective of the present disclosure is to provide a roping training device that utilizes a smaller amount of electrical power in comparison to prior art devices. A still further objective of the present disclosure is to provide a roping training device that is portable and has its own power source and, therefore, can be used at locations where there is no source of power.

In an example embodiment, a mobile roping training apparatus includes a simulated animal torso and a pair of simulated hind legs. The simulated hind legs are rotatably coupled to a rear of the simulated animal torso. The simulated hind legs may pivot forward and backward about the rear of the simulated animal torso. The apparatus includes a support frame. The simulated animal torso is rotatably coupled to the support frame, such that the simulated animal torso may pivot up and down about the support frame. The apparatus includes a drive system. The drive system includes a drive shaft, a drive pulley, and a plurality of mechanical linkages. The drive pulley is coupled to the drive shaft. Each of the plurality of mechanical linkages includes a first link and a second link. The first link is coupled to one of the simulated hind legs and rotatably coupled to a second link. The second link is rotatably coupled to the first link and coupled to one of the drive pulley and the drive shaft. In this embodiment, it is the use of the first and second links, pivotally coupled to one another, that permits the more accurate simulation of the animal's hind legs that is a primary benefit of the system disclosed herein.

In another example embodiment, a mobile roping training apparatus includes a simulated animal torso and a pair of simulated hind legs. The simulated hind legs are rotatably coupled to a rear of the simulated animal torso. The simulated hind legs may pivot forward and backward about the rear of the simulated animal torso. The apparatus includes a support frame. The simulated animal torso is rotatably coupled to the support frame, such that the simulated animal torso may pivot up and down about the support frame. The apparatus includes a drive system. The drive system includes a drive shaft, a drive pulley, and two drive cams. The drive pulley is coupled to the drive shaft. Each of the drive cams is coupled to each end of the drive shaft. Each drive cam includes a rotational cam coupled to the drive shaft. Each drive cam also includes a first link and a second link. The first link is coupled to one of the simulated hind legs and rotatably coupled to a second link. The second link is rotatably coupled to the first link and coupled to the rotational cam. In this embodiment, it is the use of the first and second links, pivotally coupled to one another as well as the rotational cam, that that permits the more accurate simulation of the animal's hind legs that is a primary benefit of the system disclosed herein.

In another example embodiment, a mobile roping training apparatus includes a simulated animal torso and a pair of simulated hind legs. The simulated hind legs are rotatably coupled to a rear of the simulated animal torso. The simulated hind legs may pivot forward and backward about the rear of the simulated animal torso. The apparatus includes a support frame. The simulated animal torso is rotatably coupled to the support frame, such that the simulated animal torso may pivot up and down about the support frame. The apparatus includes a drive system. The drive system includes a drive shaft, a drive pulley, and a plurality of mechanical linkages. The drive pulley is coupled to the drive shaft. Each of the plurality of mechanical linkages includes a first link and a second link. The first link is coupled to one of the simulated hind legs and rotatably coupled to a second link. The second link is rotatably coupled to the first link and coupled to one of the drive pulley and the drive shaft. Rotation of the drive pulley and the drive shaft causes movement of the plurality of mechanical linkages, such that the simulated hind legs pivot and move in a rearward direction as the animal torso moves toward an upward position, and such that the simulated hind legs pivot and move in a forward direction as the animal torso moves toward a downward position, thereby simulating an anatomical movement of a running animal.

For example, as the drive pulley and drive shaft rotate, each of the plurality of mechanical linkages rotate, causing: (1) the simulated hind legs to swing forward and backward about their pivot point at the simulated animal torso and (2) the rear of the simulated animal torso to move up and down about the support frame. The simulated hind legs move back and forth in concert with the up and down movement of the simulated animal torso. For example, as the simulated hind legs move backward (i.e., from a bent position underneath the torso to an extended position behind the torso), the simulated animal torso translates upward. Likewise, for example, as the simulated hind legs move forward (i.e., from an extended position behind the torso to a bent position underneath the torso), the torso translates downward. This combination of movement (e.g., back and forth leg movement and up and down torso movement) more accurately simulates the natural movement of a running animal.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been principally selected for readability and instructional purposes, and not to limit the scope of the inventive subject matter.

DETAILED DESCRIPTION OF EXAMPLE EMBODIMENTS

Figure 1:
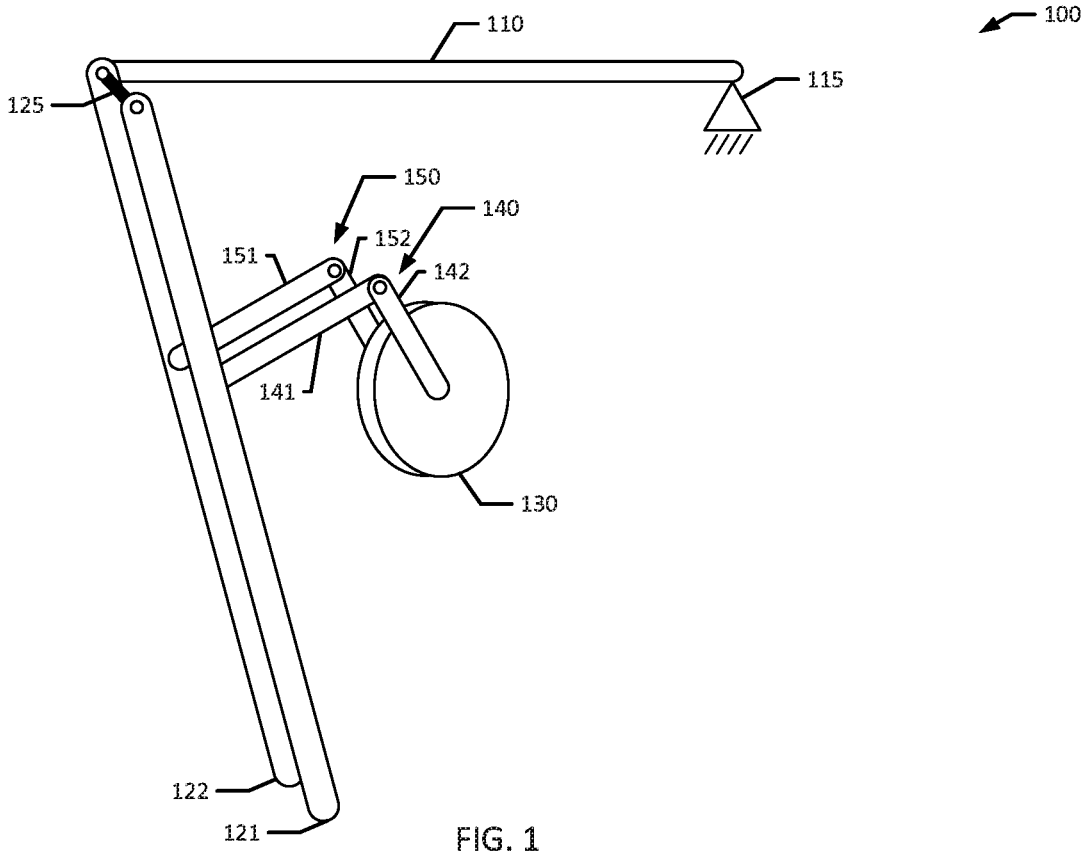
FIG. 1 is a side elevation view of a roping training apparatus, according to an example embodiment of the present disclosure.

As discussed above, an improved roping dummy hop mechanism is provided, among other significant advantages, to simulate the natural movement of a running animal. FIG. 1 illustrates a side elevation view of a roping training apparatus 100, according to an example embodiment of the present disclosure. Apparatus 100 includes a torso 110. In an example, the torso 110 includes a frame (e.g., bars or tubes). In a different example, the torso 110 includes a hollow shell (e.g., a realistic mold of an animal's torso). For example, a hollow shell may be either permanently or removably coupled to the frame. The torso 110 is connected to a support frame (not shown). For example, torso 110 is rotatably coupled to the support frame by a hinge 115. In an example, torso 110 is coupled to the hinge 115 by a front torso pivot shaft. In an example, the front torso pivot shaft is secured in place by front torso pivot shaft lugs attached to the ends of the front torso pivot shaft at hinge 115. The torso 110 may be configured to pivot up and down, with respect to the support frame, by rotating about the hinge 115. In an example embodiment, the hinge is positioned at a shoulder location for the torso 110 (e.g., when a realistic mold of an animal's torso is included, the torso 110 pivots about the hinge 115 at a shoulder location for the animal's torso).

In an example embodiment, the apparatus 100 may further include a load spring. The load spring may be coupled to both the torso 110 and to the support frame. The load spring may be configured to reduce a force required to raise or lower the torso 110 (e.g., via the mechanical movement described herein) Likewise, the load spring may be configured to reduce vibration of the apparatus 100 and related components. In a preferred embodiment, the load spring is attached to an underside of the torso 110 and to the support frame.

The apparatus 100 further includes a pair of hind legs, including a first hind leg 121 and a second hind leg 122. In an example, each of the first hind leg 121 and the second hind leg 122 are frames (e.g., bars or tubes). In a different example, each of the first hind leg 121 and the second hind leg 122 includes a hollow shell (e.g., a realistic mold of an animal's leg). For example, a hollow shell may be either permanently or removably coupled to frames of the first hind leg 121 and the second hind leg 122. The first hind leg 121 and the second hind leg 122 are rotatably coupled to the rear of the torso 110 by a rear torso pivot shaft 125. In an example, the rear torso pivot shaft 125 is secured in place by rear torso pivot shaft lugs attached to the ends of the rear torso pivot shaft 125. The first hind leg 121 and the second hind leg 122 may be configured to pivot forward and backward about the rear torso pivot shaft 125 (e.g., the legs may pivot about the rear of the torso 110).

In an example embodiment, each of the first hind leg 121 and the second hind leg 122 has a sleeve to ensure close tolerance, free rotation, and a durable contact surface between the hind leg and the rear torso pivot shaft 125. In other example embodiments, each of the first hind leg 121 and the second hind leg 122 are equipped with a bearing or bushing between the hind leg 121/122 and the rear torso pivot shaft 125.

In an example embodiment, the support frame is vertically adjustable, such that the height of the torso 110, the first hind leg 121, and second hind leg 122 may be modified. For example, the resting height of the torso 110 may typically be four feet off the ground. This resting height of the torso may be modified, via the adjustable support frame, so that the resting height of the torso 110 is between three feet off the ground and five feet off the ground. More particularly, for example, a vertical frame member may interface with a vertical structural sleeve. The vertical structural sleeve is a section of the support frame (e.g., a tubular metal beam) which slides, with close tolerance, over the vertical frame member. The vertical frame member has a series of openings passing through both sides of the vertical frame member at a plurality of elevations. Likewise, the vertical structural sleeve has a series of series of openings passing through both sides of the vertical structural sleeve at a plurality elevations. The height of the torso 110 (e.g., height above ground level) is adjusted by sliding the vertical structural sleeve up and down to the desired level and subsequently inserting a pin through a vertical structural sleeve opening and an aligned vertical frame member opening.

Apparatus 100 further includes a drive system, including a drive shaft and a drive pulley 130, coupled to the drive shaft. For example, the drive pulley 130 is coupled to the drive shaft via gearing, a keyed-slot, an interference fit, or other similar mechanical means for engaging with an axial drive shaft. The drive system further includes a plurality of mechanical linkages, such as a first mechanical linkage 140 and a second mechanical linkage 150. In an example embodiment, each of the first mechanical linkage 140 and the second mechanical linkage 150 may be coupled to one of the drive pulley 130 or the drive shaft.

More specifically, the first mechanical linkage 140 includes a first link 141 and a second link 142. The first link 141 is coupled to the first hind leg 121 and is also rotatably coupled to the second link 142. For example, the first link 141 may be coupled to the first hind leg 121 via a weld. In an example, the first link 141 is rotationally fixed with respect to the first hind leg 121 (e.g., the first link 141 does not rotate about the first hind leg 121 at the coupling between the first hind leg 121 and the first link 141) Likewise, for example, the first link 141 may be coupled to the second link 142 via a bearing, a bushing, or some other rotational component (e.g., the first link 141 and the second link 142 may rotate or pivot at the coupling between these two components). The second link 142 is rotatably coupled to the first link 141 (as described above) and is also coupled to one of the drive pulley 130 or the drive shaft. For example, the second link 142 is coupled to one of the drive pulley 130 or the drive shaft via a weld. In an example, the second link 142 is rotationally fixed with respect to the drive pulley 130 (e.g., the second link 142 does not rotate about the drive pulley 130 at the coupling between the second link 142 and the drive pulley).

Similarly, the second mechanical linkage 150 includes a first link 151 and a second link 152. The first link 151 is coupled to the second hind leg 122 and is also rotatably coupled to the second link 152. For example, the first link 151 may be coupled to the second hind leg 122 via a weld. In an example, the first link 151 is rotationally fixed with respect to the second hind leg 122 (e.g., the first link 151 does not rotate about the second hind leg 122 at the coupling between the second hind leg 122 and the first link 151). Likewise, for example, the first link 151 may be coupled to the second link 152 via a bearing, a bushing, or some other rotational component (e.g., the first link 151 and the second link 152 may rotate or pivot at the coupling between these two components). The second link 152 is rotatably coupled to the first link 151 (as described above) and is also coupled to one of the drive pulley 130 or the drive shaft. For example, the second link 152 is coupled to one of the drive pulley 130 or the drive shaft via a weld. In an example, the second link 152 is rotationally fixed with respect to the drive pulley 130 (e.g., the second link 152 does not rotate about the drive pulley 130 at the coupling between the second link 152 and the drive pulley).

In an alternate example embodiment, each of the first mechanical linkage 140 and the second mechanical linkage 150 are coupled to respective rotational cams. For example, the second link 142 of the first mechanical linkage 140 may be coupled to a first rotational cam. The first rotational cam may be coupled to an end of the drive shaft. Likewise, for example, the second link 152 of the second mechanical linkage 150 may be coupled to a second rotational cam. The second rotational cam may be coupled to the other end of the drive shaft. For example, each of the first rotational cam and second rotational cam may be coupled to the drive shaft via gearing, a keyed-slot, an interference fit, or other similar mechanical means for engaging with an axial drive shaft.

In another alternate example embodiment, apparatus 100 only includes one mechanical linkage (e.g., either first mechanical linkage 140 or second mechanical linkage 150). For example, one single linkage (e.g., second mechanical linkage 150) may be coupled to the drive pulley 130 and to both of the first hind leg 121 and the second hind leg 122 (e.g., via a connecting bracket). In this alternate embodiment, only one mechanical linkage is required to perform movement of the hind legs 121/122 and torso 110 as described herein.

In an example embodiment, the drive system of the apparatus 100 includes an adjustment pulley. For example, the drive pulley 130 may be an adjustment pulley. An adjustment pulley is configured to adjust the speed of movement for the torso 110, the first hind leg 121, and the second hind leg 122. More particularly, an adjustment pulley may include a split pulley having at least two different diameters. For example, the split pulley may include a first diameter and a second diameter, each forming a deep "v" receptacle for receiving a drive belt. The adjustment pulley may further include the drive belt, connecting the split pulley to a power source (e.g., a plurality of wheels, a motor, or other rotational components, as described in greater detail below). The adjustment pulley may further include a spring loaded tensioner, configured to provide adjustment of the tension of the drive belt (e.g., via a twist knob). For example, the spring loaded tensioner may provide for a "loosening" of the drive belt, such that the drive belt may be manually moved between the first diameter on the split pulley to the second diameter on the split pulley. Belt tension may then be readjusted by the spring loaded tensioner. By adjusting a position of the drive belt (e.g., from the first diameter on the split pulley to the second diameter on the split pulley), a gearing ratio between the split pulley and the power source may be changed. Changing this gearing ratio may result in a change of the speed of movement for the torso 110, the first hind leg 121, and the second hind leg 122.

In one example embodiment, the drive system may be powered by kinetic energy via towing. For example, the support frame of the apparatus 100 may include a hitch. The hitch may be configured such that a towing device (e.g., truck, all-terrain vehicle, motorcycle, bicycle, horse, or other towing means) may be coupled to the support frame. Likewise, in an example embodiment, apparatus 100 may further include a plurality of wheels (e.g., coupled to the support frame of the apparatus 100). For example, responsive to the apparatus 100 being towed by the towing device, the plurality of wheels rotate (e.g., via contact with the ground). Rotational force of the plurality of wheels may be translated to the drive system (e.g., via shafts, pulleys, belts, chains, or other rotational components). In this way, the drive system may be powered by the plurality of wheels via the kinetic energy of the towing device. In an alternate example embodiment, the apparatus 100 may be self-propelled, such that no external towing device is required.

In a related example embodiment, the apparatus 100 may be towed at a constant speed (e.g., 10 miles-per-hour), while simultaneously providing for a number of different movement speeds (e.g., torso and leg movement speed). For example, with reference to the adjustment pulley described above, by adjusting a position of the drive belt (e.g., from the first diameter on the split pulley to the second diameter on the split pulley), the gearing ratio between the split pulley and the power source (e.g., the plurality of wheels) is changed. Changing this gearing ratio may result in a change of the speed of movement for the torso 110, the first hind leg 121, and the second hind leg 122, though the towing speed (e.g., 10 miles-per-hour) remains constant.

In an example embodiment, the support frame of the apparatus 100 may additionally include a plurality of frame skid members. The plurality of frame skid members may contact the ground, and may be configured to permit the apparatus 100 to slide along the ground while it is being towed (e.g., for moving practice). For example, frame skid members (e.g., tubular metal beams) may be curved up at a front end to ensure efficient sliding with the ground during normal use. Frame skid members may be coupled (e.g., welded) to the support frame of the apparatus 100. Alternatively, frame skid members may be removable from the support frame of the apparatus 100.

In another example embodiment, the drive system may be powered by a motor. For example, the motor may be mounted to the support frame of the apparatus 100. Rotational force of the motor may be translated to the drive system (e.g., via shafts, pulleys, belts, chains, or other rotational components). More particularly, for example, the motor may include a motor pulley driven by a motor shaft. Motor pulley may transfer power to the drive system (e.g., via belts, chains, gearing, or other rotational components). In an example, motor may be a 12 volt DC motor connected by a cable to an off switch and a 12 volt battery. Each of the motor, cable, switch, and battery may be mounted to the support frame of the apparatus 100. In other examples, motor may be an internal combustion engine, or any other type of energy source. In example embodiments with motor-driven drive systems, apparatus 100 may be stationary or may be towed via a towing device (as described above). In yet another example embodiment, the drive system may have multiple power sources (e.g., both by kinetic energy via towing and by a motor).

As disclosed, apparatus 100 simulates the movement of a running animal. For example, with reference to FIG. 1, rotation of the drive pulley 130 and the drive shaft cause the movement of each of the first mechanical linkage 140 and the second mechanical linkage 150. More specifically, for example, with the first mechanical linkage 140, the second link 142 rotates with the drive pulley 130; the first link 141 pivots about the second link 142 (e.g., via the rotatable coupling). Likewise, for example, with the second mechanical linkage 150, the second link 152 rotates with the drive pulley 130; the first link 151 pivots about the second link 152 (e.g., via the rotatable coupling). Movement of each of the first mechanical linkage 140 and the second mechanical linkage 150 results in movement of each of the first hind leg 121, the second hind leg 122, and the torso 110. For example, the first hind leg 121 and the second hind leg 122 pivot and move in a rearward direction as the torso 110 moves toward an upward position. Likewise, for example, the first hind leg 121 and the second hind leg 122 pivot and move in a forward direction as the torso 110 moves toward a downward position.

Figure 2:
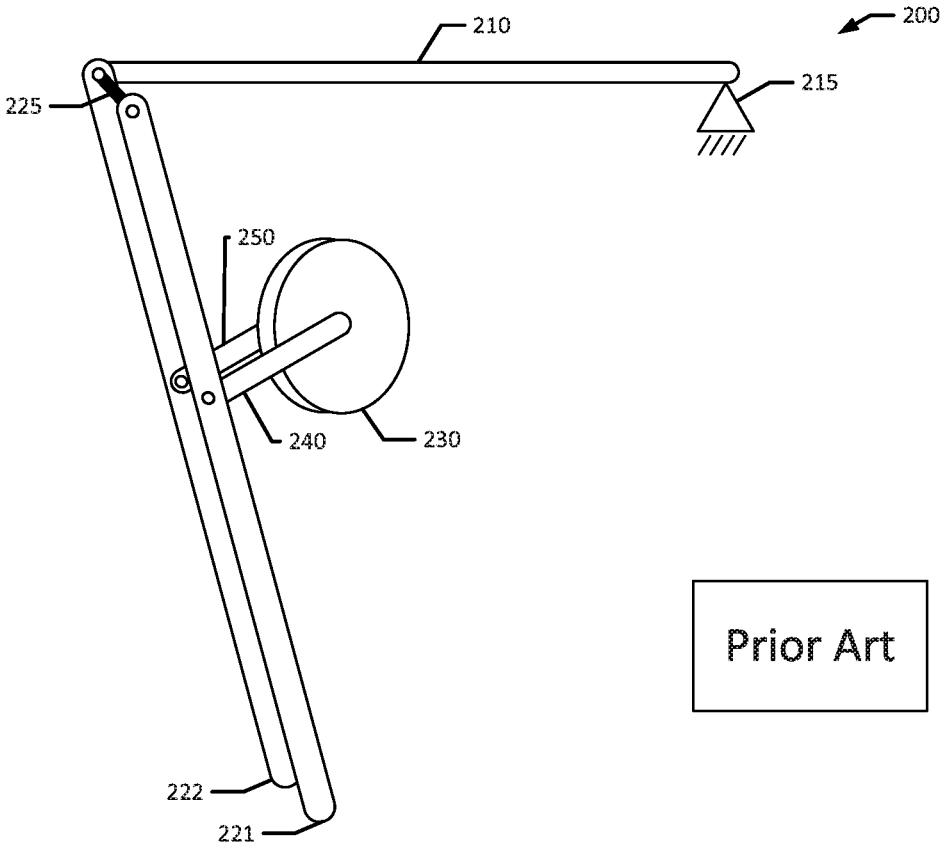
FIG. 2 is a side elevation view of a roping training apparatus, according to the prior art.

By comparison to FIG. 1, FIG. 2 illustrates a side elevation view of a roping training apparatus 200, according to the prior art. It is readily apparent that the roping training apparatus 200 does not include structure disclosed by the present disclosure. For example, the roping training apparatus 200 does not include the first mechanical linkage 140 with the first link 141 and the second link 142. Likewise, the roping training apparatus 200 does not include the second mechanical linkage 150 with the first link 151 and the second link 152. The absence of multiple links (e.g., first link 141 and second link 142) further results in the absence of particular structure (e.g., rotatable coupling between first like 141 and second link 142), which provides particular motion characteristics.

The roping training apparatus 200 is unable to perform the motion disclosed by apparatus 100. More specifically, by lacking features of apparatus 100 (e.g., at least the first mechanical linkage 140 and the second mechanical linkage 150), rotation of a pulley 230 and respective flange 240 moves the hind legs (e.g., first hind leg 221) in a different motion than that of apparatus 100. For example, the hind legs (e.g., first hind leg 221) pivot in a rearward direction as the torso 210 moves toward a downward position. Likewise, for example, the hind legs pivot and move in a forward direction as the torso 110 moves toward an upward position. In other words, the roping training apparatus 200 (as taught by the prior art) performs an opposite motion simulation to that of apparatus 100.

Figure 3A:
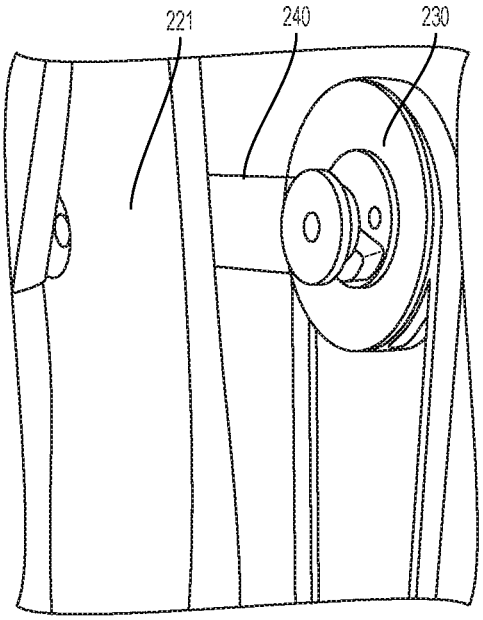
FIG. 3A PRIOR ART
FIGS. 3A and 3B are side elevation views of drive cams, according to both the prior art and an example embodiment of the present disclosure.
Figure 3B:
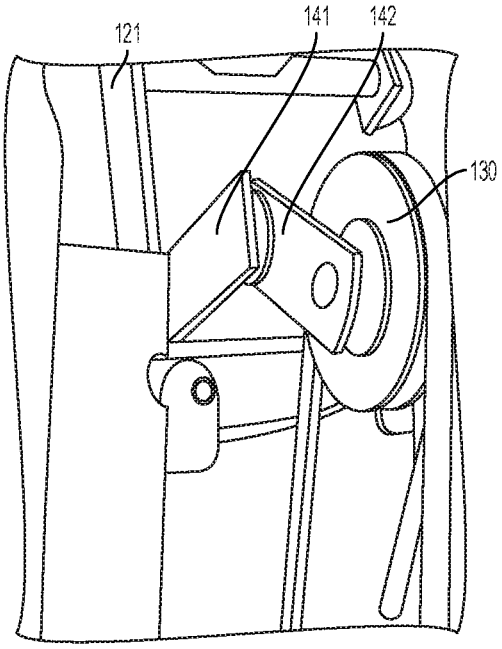

Again, for comparison, FIGS. 3A and 3B illustrate side elevation views of drive cams, according to both the prior art and an example embodiment of the present disclosure. FIG. 3A illustrates the roping training apparatus 200, as taught by the prior art. This includes the flange 240, which is coupled to the pulley 230 (e.g., via a non-rotatable coupling). For example, the flange 240 is welded to the pulley 230. The flange 240 is also coupled to the first hind leg 221 (e.g., via a rotatable coupling). For example, the rotatable coupling may be a sleeve, a bearing, or any other coupling to ensure free rotation and durable contact between the first hind leg 221 and the flange 240. The first hind leg 221 pivots about the flange 240 at the rotatable coupling.

By comparison, FIG. 3B illustrates features of apparatus 100 that are not taught by the prior art. For example, apparatus 100 includes a mechanical linkage (e.g., first linkage 140), which includes a first link 141 and a second link 142. The first link 141 is coupled to the first hind leg 121 (e.g., via a non-rotatable coupling). For example, the first link 141 is welded to the first hind leg 121. The first link 141 is also rotatably coupled to the second link 142. For example, the rotatable coupling may be a sleeve, a bearing, or any other coupling to ensure free rotation and durable contact between the first link 141 and the second link 142. The first link 141 pivots about the second link 142 at the rotatable coupling. The second link 142 is also coupled to the drive pulley 130 (e.g., via a non-rotatable coupling). For example, the second link 142 is welded to the drive pulley 130.

Figure 4A:
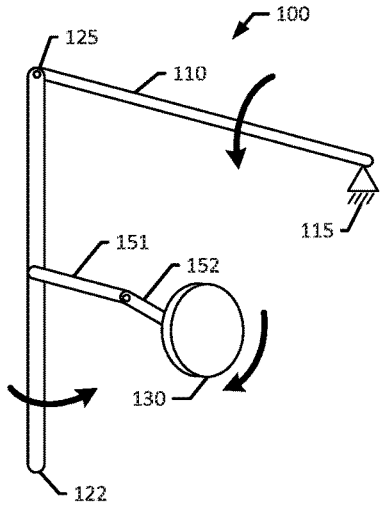
FIGS. 4A, 4B, and 4C are side elevation views of a roping training apparatus in various stages of an alternate leg and torso movement, according to example embodiments of the present disclosure.
Figure 4B:
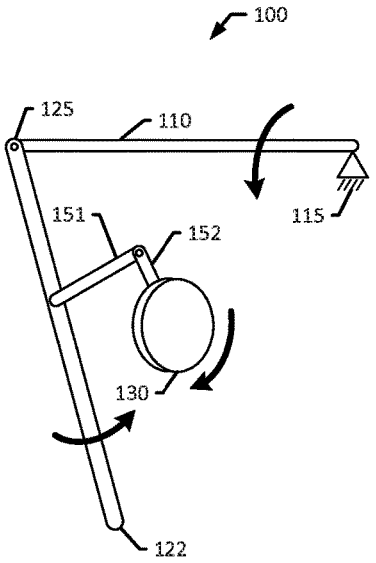
Figure 4C:
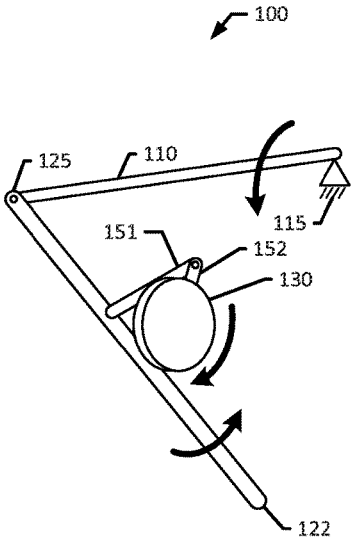

FIGS. 4A, 4B, and 4C illustrate side elevation views of the roping training apparatus 100 in various stages of the alternate leg and torso movement, according to example embodiments of the present disclosure. As noted previously, this new and alternate leg and torso movement is a more realistic simulation of anatomical movement. It should be noted that each of FIGS. 4A to 4C illustrate movement of one side of the apparatus 100 (e.g., second hind leg 122 via second mechanical linkage 150). Similar movement should be expected of the other side of the apparatus 100 (e.g., first hind leg 121 via first mechanical linkage 140). Moreover, as described previously, each of the first hind leg 121 and the second hind leg 122 are rotatably coupled to the rear of the torso 110 by the rear torso pivot shaft 125. Thus, both hind legs may be configured to pivot forward and backward about the rear torso pivot shaft 125 concurrently (e.g., the legs may pivot about the rear of torso 110 together).

In a first orientation, illustrated by FIG. 4A, drive pulley 130 rotates in a clockwise direction. Likewise, because the second link 152 is coupled to the drive pulley 130, the second link 152 rotates in a clockwise direction. The first link 151, which is rotatably coupled to the second link 152, likewise moves generally in a clockwise direction. However, because the first link 151 is coupled to second hind leg 122, first link 151 also translates forward and backward. This forward-backward translation is, likewise, imparted onto the second hind leg 122. The second hind leg 122 rotates in a counter-clockwise direction, about the torso pivot shaft 125. The torso 110 rotates in a counter-clockwise direction, about the hinge 115.

In the first orientation, illustrated by FIG. 4A, the hind legs (e.g., second hind leg 122) are at an extended position behind the torso. For example, the distal ends of the hind legs are extended as far back as possible (e.g., away from the torso 110 and the hinge 115). Likewise, in the first orientation, the torso 110 is at a peak height (e.g., as far away from the ground as possible).

In a second orientation, illustrated by FIG. 4B, the hind legs (e.g., second hind leg 122) have moved forward (e.g., toward the torso 110 and the hinge 115). Likewise, in the second orientation, the torso 110 has moved downward (e.g., closer to the ground).

In a third orientation, illustrated by FIG. 4C, the hind legs (e.g., second hind leg 122) have moved more forward than in FIG. 4B (e.g., toward the torso 110 and the hinge 115). Likewise, in the third orientation, the torso 110 has moved more downward than in FIG. 4B (e.g., closer to the ground).

At a certain point, during rotation of drive pulley 130 in the clockwise direction, movement of the hind legs (e.g., second hind leg 122) and the torso 110 will reverse. For example, the hind legs (e.g., second hind leg 122) will move backward (e.g., away from the torso 110 and the hinge 115). Likewise, for example, the torso 110 will move upward (e.g., away from the ground).

Figure 5A:
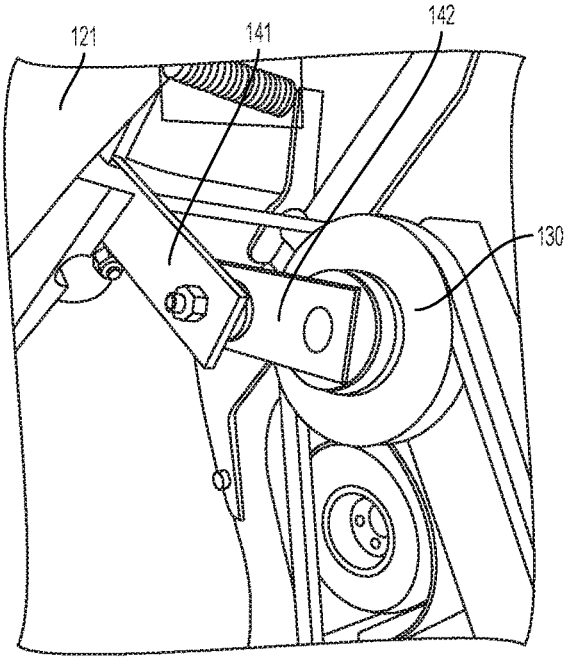
FIGS. 5A and 5B are side elevation views of drive cams, according to example embodiments of the present disclosure.
Figure 5B:
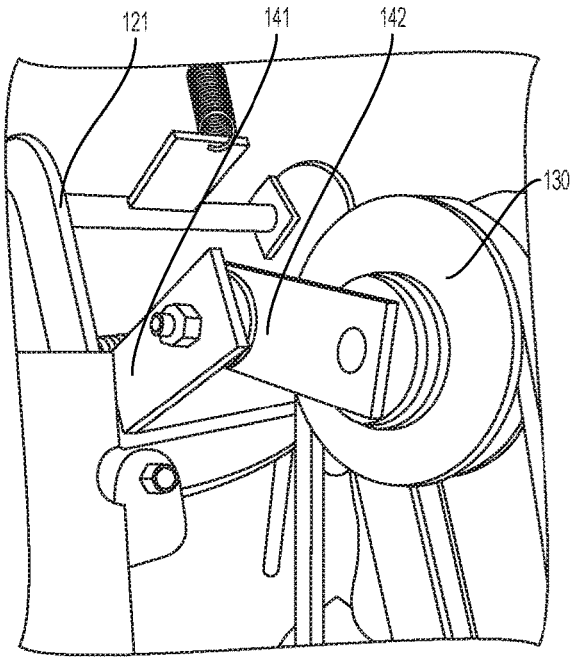

FIGS. 5A and 5B illustrate side elevation views of drive cams, according to example embodiments of the present disclosure. FIG. 5A illustrates a first configuration of the drive cam, including the drive pulley 130, the first link 141 and the second link 142. The first link 141 is coupled to the first hind leg 121 and is also rotatably coupled to the second link 142. The second link 142 is rotatably coupled to the first link 141 and is also coupled to the drive pulley 130. FIG. 5B illustrates a second configuration of the drive cam. As illustrated by FIG. 5B, the first link 141 pivots about the second link 142 (e.g., via the rotatable coupling). By comparison, the first link 141 is coupled to the first hind leg 121 (e.g., via a non-rotatable coupling). In an embodiment, the first link 141 is fastened to the first hind leg 121. In a different embodiment, the first link 141 is welded to the first hind leg 121. Likewise, the second link 142 is coupled to the drive pulley 130 (e.g., via a non-rotatable coupling). In an embodiment, the second link 142 is fastened to the drive pulley 130. In a different embodiment, the second link 142 is welded to the drive pulley 130.

Figure 6:
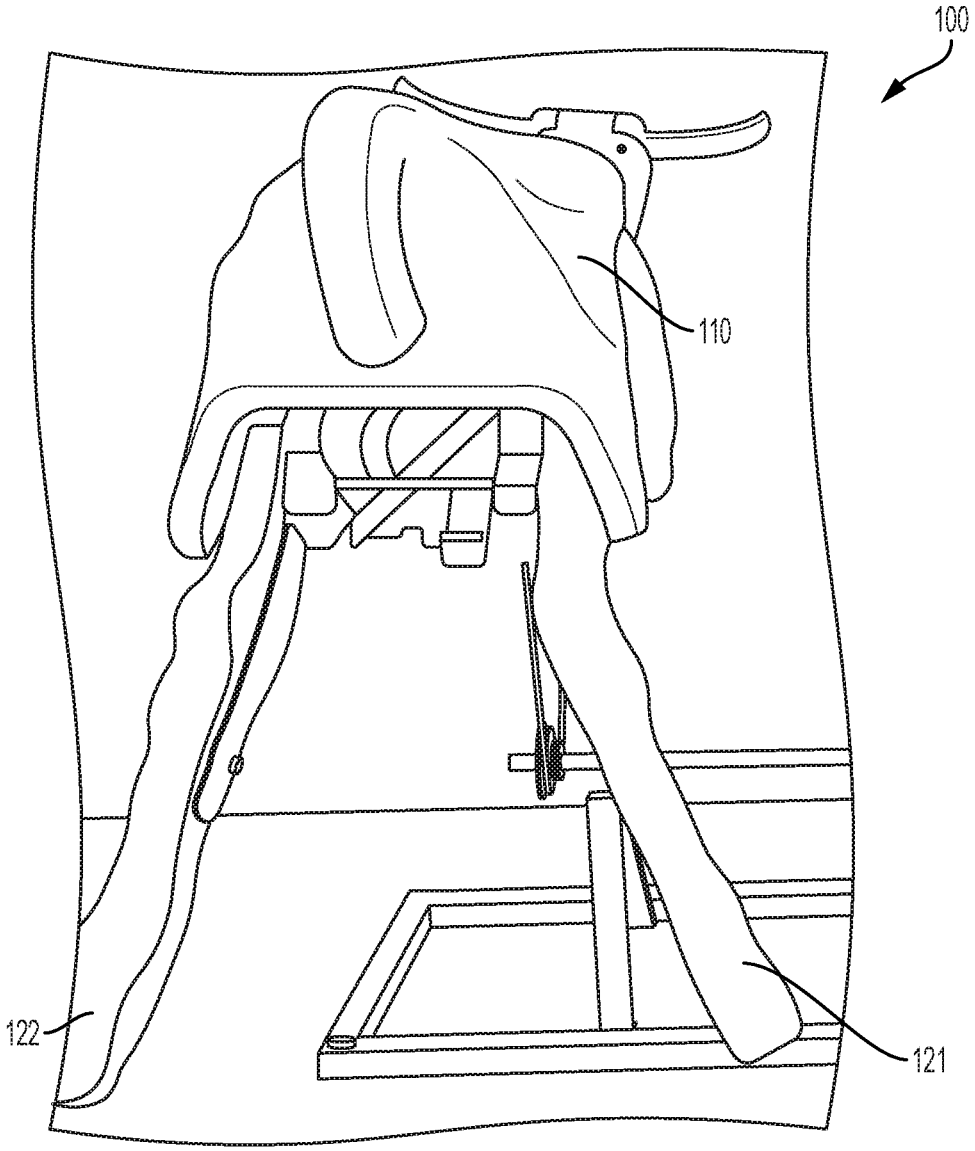
FIG. 6 is a rear elevation view of a roping training apparatus, according to an example embodiment of the present disclosure.

FIG. 6 illustrates a rear elevation view of the roping training apparatus 100, according to an example embodiment of the present disclosure. As noted previously, in particular embodiments, the torso 110 includes a hollow shell (e.g., a realistic mold of an animal's torso). In related embodiments, the torso 110 may further include an animal's head. For example, roping training apparatus 100 may provide for a full simulated torso 110 and a simulated head, for simultaneous team practice of heeling and heading techniques. In a related embodiment, the head may also alternatively be with or without horns. Likewise, in particular embodiments, the first hind leg 121 and the second hind leg 122 include a hollow shell (e.g., a realistic mold of an animal's leg). The first hind leg 121 and the second hind leg 122 are rotatably coupled to the rear of the torso 110. The sizes of the torso 110 and the first hind leg 121 and the second hind leg 122 may be steer size, for competition practicing, or may be any size from bull size to calf size, for practicing ranch skills.

FIGS. 7 to 15 are side elevation views showing a sequential series of movements of the roping training apparatus 100, according to example embodiments of the present disclosure, that simulate the more anatomically correct movement of a live roping target. More particularly, FIGS. 7 to 15 may illustrate a more detailed depiction of the various stages of the alternate leg and torso movement of the roping training apparatus 100 (previously described above with reference to FIGS. 4A to 4C), including the torso 110 that is rotatably coupled to the support frame by the hinge 115.

Figure 7:
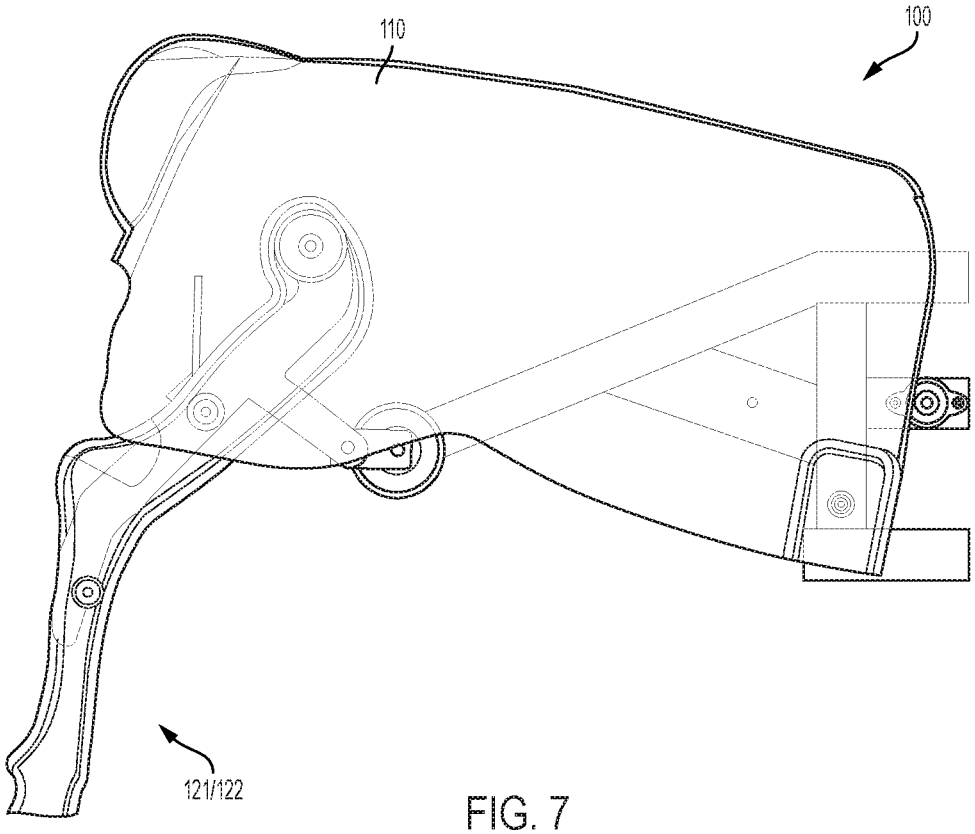
FIGS. 7 to 15 are side elevation views showing a sequential series of movements of a roping training apparatus, according to example embodiments of the present disclosure, that simulates the more anatomically correct movement of a live roping target animal.
Figure 8:
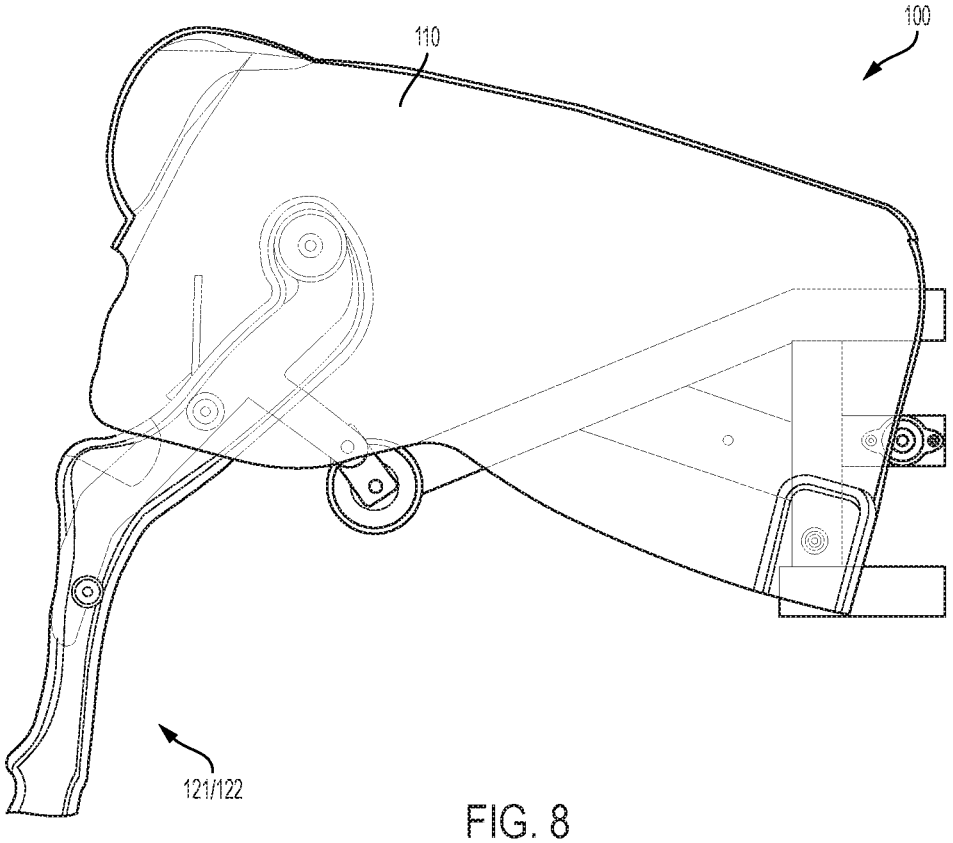
Figure 9:
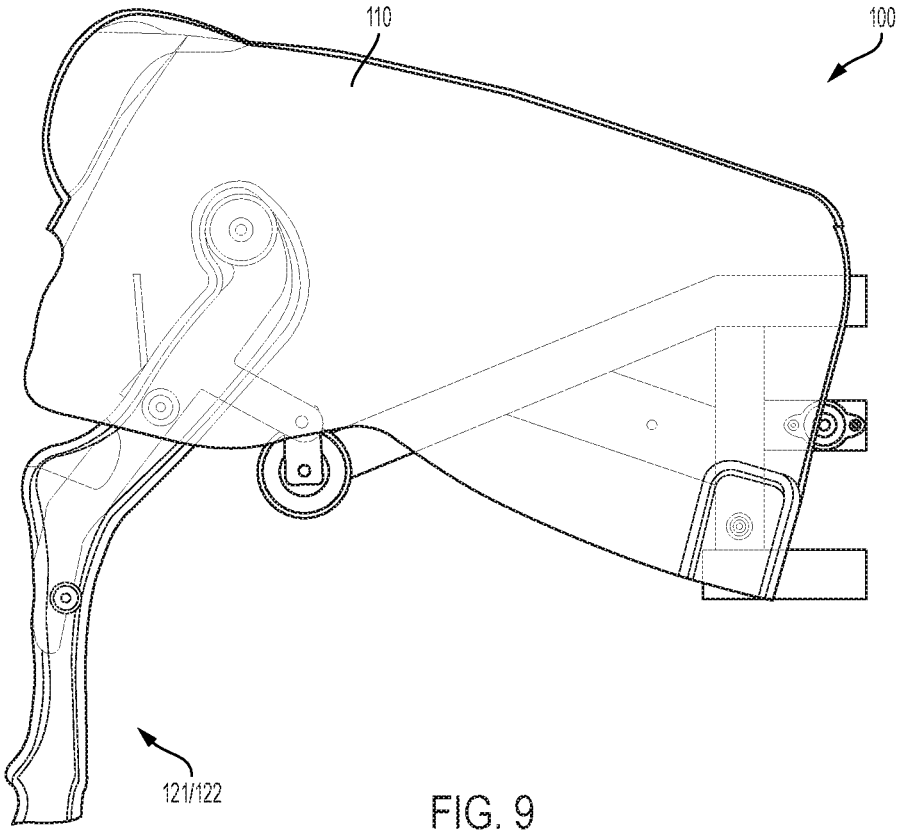
Figure 10:
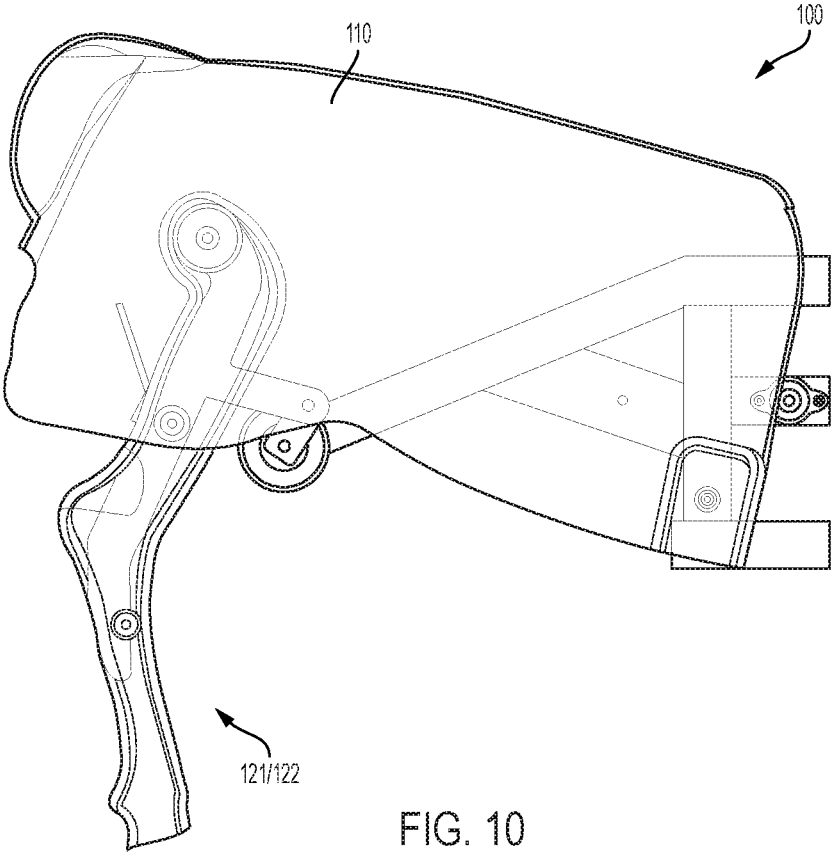
Figure 11:
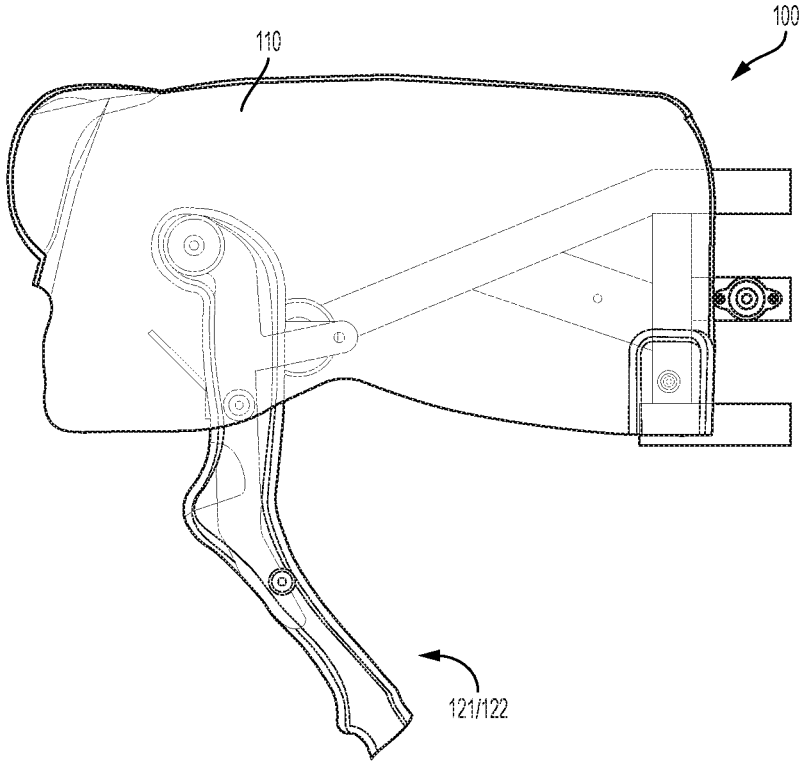
Figure 12:
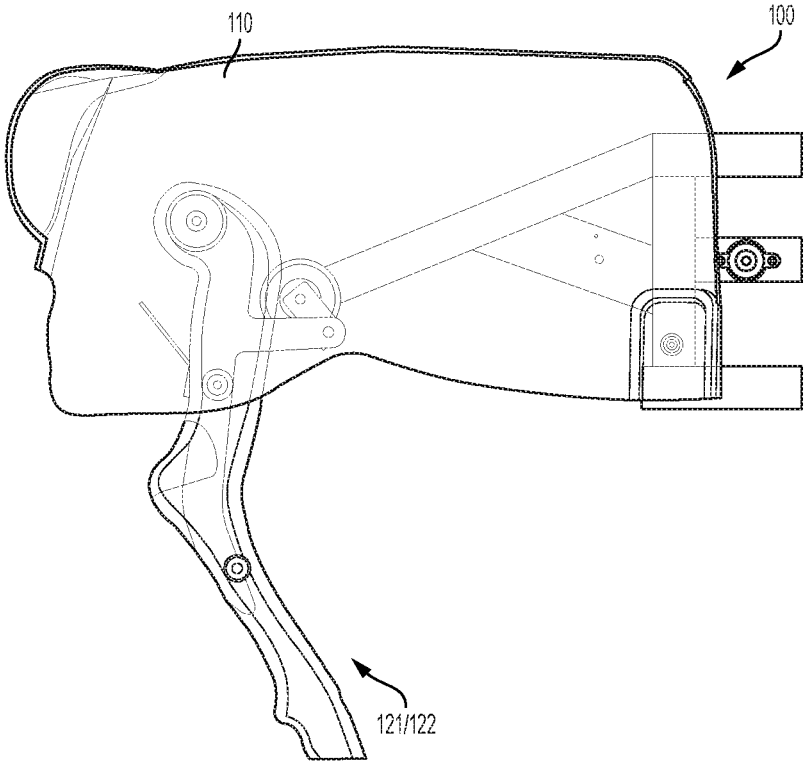
Figure 13:
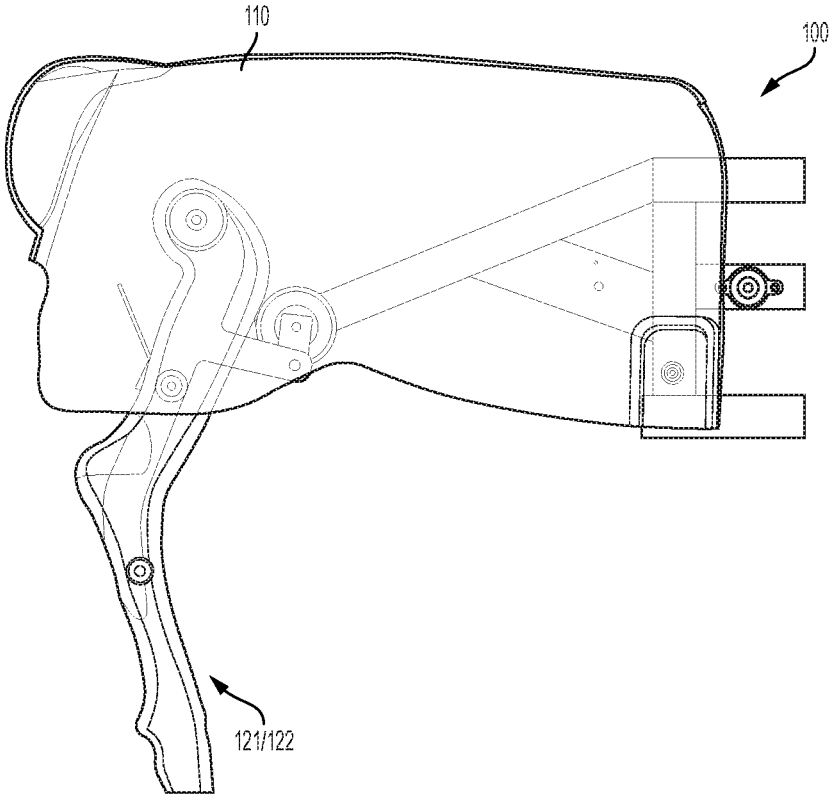
Figure 14:
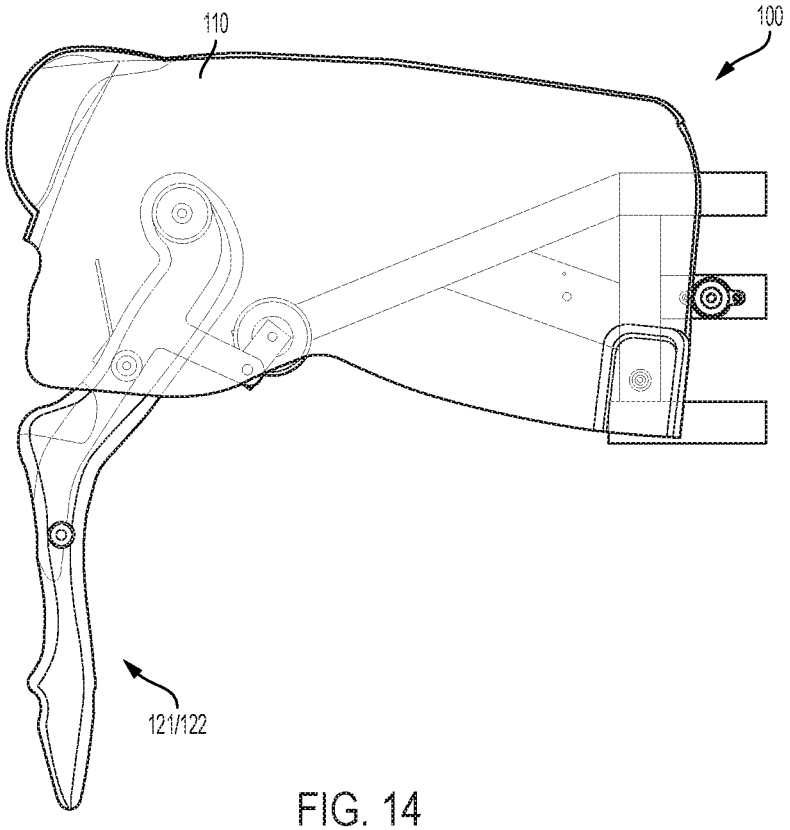
Figure 15:
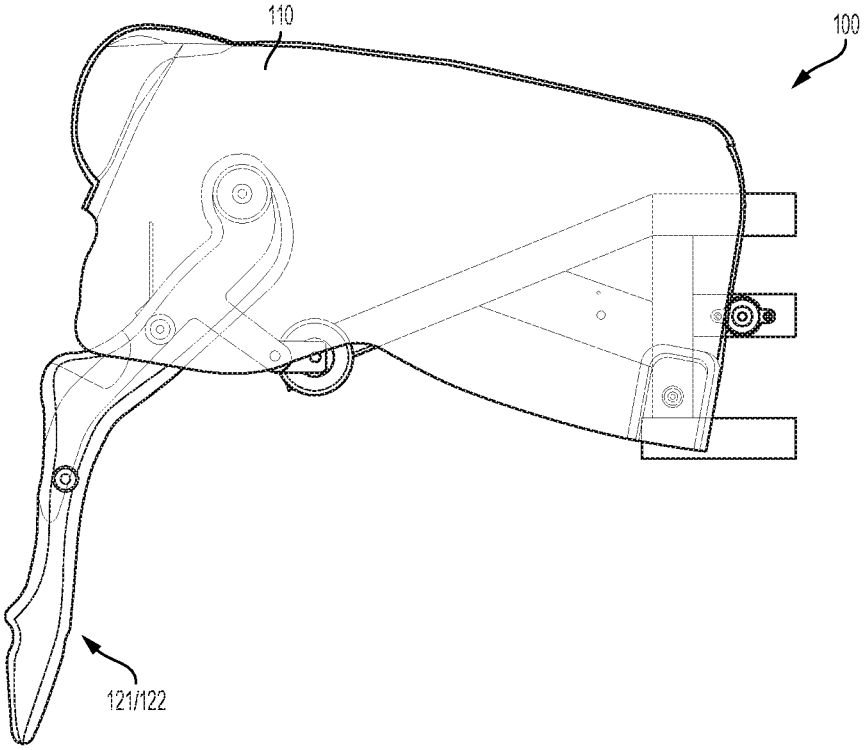

In the various stages illustrated by FIGS. 7 to 15, components of the roping training apparatus 100 that were previously described (e.g., drive pulley 130, first mechanical linkage 140, second mechanical linkage 150) are used to simulate the motion of the torso 110 and each of the first hind leg 121 and the second hind leg 122. As illustrated, both hind legs are configured to pivot forward and backward concurrently (e.g., hind legs 121/122 may pivot about the rear of torso 110 together). FIGS. 7 and 8 illustrate the hind legs 121/122 at an extended position behind the torso 110 (e.g., away from the torso 110), while the torso 110 is at a peak height (e.g., as far away from the ground as possible). FIGS. 9 and 10 illustrate the hind legs 121/122 moving forward (e.g., toward the torso 110), while the torso 110 has moved downward (e.g., closer to the ground). FIGS. 11 and 12 illustrate the hind legs 121/122 at a bent position underneath the torso 110 (e.g., closest to the torso 110), while the torso 110 is at its lowest point (e.g., closest to the ground). FIGS. 13 to 15 illustrate the hind legs 121/122 moving backward (e.g., away from torso 110), while the torso 110 has moved upward (e.g., away from the ground). Thus, FIGS. 7 to 15 illustrate one complete cycle of movement of the roping training apparatus 100 and related torso 110 and hind legs 121/122.

The many features and advantages of the present disclosure are apparent from the written description, and thus, the appended claims are intended to cover all such features and advantages of the disclosure. Further, since numerous modifications and changes will readily occur to those skilled in the art, the present disclosure is not limited to the exact construction and operation as illustrated and described. Therefore, the described embodiments should be taken as illustrative and not restrictive, and the disclosure should not be limited to the details given herein but should be defined by the following claims and their full scope of equivalents, whether foreseeable or unforeseeable now or in the future.

The invention is claimed as follows:

1. A mobile roping training apparatus comprising:
- a simulated animal torso;
- a pair of simulated hind legs, wherein the simulated hind legs are rotatably coupled to a rear of the simulated animal torso, such that the simulated hind legs may pivot forward and backward about the rear of the simulated animal torso;
- a support frame, wherein the simulated animal torso is rotatably coupled to the support frame, such that the simulated animal torso may pivot up and down about the support frame; and
- a drive system, including:
  - a drive shaft,
  - a drive pulley, coupled to the drive shaft, and
  - a plurality of mechanical linkages, wherein each mechanical linkage includes:
    - a first link having a first end and a second end, wherein the first end of the first link is non-rotatably coupled to one of the simulated hind legs, such that an angle between the first link and one of the simulated hind legs is fixed, and wherein the second end of the first link is rotatably coupled to a second link, and
    - the second link having a first end and a second end, wherein the first end of the second link is rotatably coupled to the second end of the first link and wherein the second end of the second link is non-rotatably coupled to one of the drive pulley and the drive shaft,
    - such that the first link and the second link are the only linkage components disposed between the pair of simulated hind legs and the drive pulley or the drive shaft.

2. The apparatus in claim 1, wherein the simulated animal torso comprises a hollow shell.

3. The apparatus in claim 1, further comprising a load spring coupled to both the simulated animal torso and to the support frame, the load spring configured to reduce a force required to raise the simulated animal torso and configured to reduce vibration.

4. The apparatus of claim 1, wherein the support frame is vertically adjustable, such that the height of the simulated animal torso and simulated hind legs may be modified.

5. The apparatus of claim 1, wherein the support frame includes frame skid members, configured to permit the apparatus to slide along the ground while being towed.

6. The apparatus of claim 1, wherein the support frame includes a hitch, such that a towing device may be coupled to the support frame with the hitch.

7. The apparatus of claim 1, further comprising a plurality of wheels rotatably coupled to the support frame, such that, responsive to the apparatus being towed by a towing device, the plurality of wheels rotate and rotational force of the plurality of wheels is translated to the drive system, wherein the drive system is powered by the plurality of wheels via kinetic energy of the apparatus.

8. The apparatus of claim 1, further comprising a motor, wherein the drive system is powered by the motor.

9. The apparatus of claim 1, wherein the drive pulley is an adjustment pulley, configured to adjust a speed of movement for the simulated animal torso and the simulated hind legs.

10. A mobile roping training apparatus comprising:
- a simulated animal torso;
- a pair of simulated hind legs, wherein the simulated hind legs are rotatably coupled to a rear of the simulated animal torso, such that the simulated hind legs may pivot forward and backward about the rear of the simulated animal torso;
- a support frame, wherein the simulated animal torso is rotatably coupled to the support frame, such that the simulated animal torso may pivot up and down about the support frame; and
- a drive system, including:
  - a drive shaft,
  - a drive pulley, coupled to the drive shaft,
  - a first drive cam, coupled to a first end of the drive shaft, and
  - a second drive cam, coupled to a second end of the drive shaft,
  - wherein each of the first drive cam and the second drive cam includes:
    - a rotational cam, coupled to the drive shaft,
    - a first link having a first end and a second end, wherein the first end of the first link is non-rotatably coupled to one of the simulated hind legs, such that an angle between the first link and one of the simulated hind legs is fixed, and wherein the second end of the first link is rotatably coupled to a second link, and
    - the second link having a first end and a second end, wherein the first end of the second link is rotatably coupled to the second end of the first link and wherein the second end of the second link is non-rotatably coupled to the rotational cam,
    - such that the first link and the second link are the only linkage components disposed between the pair of simulated hind legs and the rotational cam.

11. The apparatus of claim 10, wherein the drive pulley includes:
- a split pulley, having at least two different diameters,
- a drive belt, connecting the split pulley to a power source, and
- a spring loaded tensioner, configured to provide adjustment of the tension of the drive belt,
- such that by adjusting a position of the drive belt from a first diameter on the split pulley to a second diameter on the split pulley, a gearing ratio between the split pulley and the power source changes.

12. The apparatus of claim 11, further comprising a plurality of wheels rotatably coupled to the support frame such that, responsive to the apparatus being towed by a towing device, the plurality of wheels rotate and rotational force of the plurality of wheels is translated to the drive system, wherein the drive system is powered by the plurality of wheels via kinetic energy of the apparatus.

13. The apparatus of claim 11, wherein the power source is a motor.

14. The apparatus of claim 13, wherein the motor is mounted to the support frame.

15. The apparatus in claim 10, wherein the simulated animal torso comprises a hollow shell.

16. The apparatus in claim 10, further comprising a load spring coupled to both the simulated animal torso and to the support frame, the load spring configured to reduce a force required to raise the simulated animal torso and configured to reduce vibration.

17. The apparatus of claim 10, wherein the support frame is vertically adjustable, such that the height of the simulated animal torso and simulated hind legs may be modified.

18. The apparatus of claim 10, wherein the support frame includes frame skid members, configured to permit the apparatus to slide along the ground while being towed.

19. The apparatus of claim 10, wherein the support frame includes a hitch, such that a towing device may be coupled to the support frame with the hitch.

20. A mobile roping training apparatus comprising:

a simulated animal torso;

a pair of simulated hind legs, wherein the simulated hind legs are rotatably coupled to a rear of the simulated animal torso, such that the simulated hind legs may pivot forward and backward about the rear of the simulated animal torso;

a support frame, wherein the simulated animal torso is rotatably coupled to the support frame, such that the simulated animal torso may pivot up and down about the support frame; and a drive system, including:

a drive shaft, a drive pulley, coupled to the drive shaft, and a plurality of mechanical linkages, wherein each mechanical linkage includes:

a first link having a first end and a second end, wherein the first end of the first link is non-rotatably coupled to one of the simulated hind legs, such that an angle between the first link and one of the simulated hind legs is fixed, and wherein the second end of the first link is rotatably coupled to a second link, and the second link having a first end and a second end, wherein the first end of the second link is rotatably coupled to the second end of the first link and wherein the second end of the second link is non-rotatably coupled to one of the drive pulley and the drive shaft, such that the first link and the second link are the only linkage components disposed between the pair of simulated hind legs and the drive pulley or the drive shaft, wherein rotation of the drive pulley and the drive shaft causes movement of the plurality of mechanical linkages, such that the simulated hind legs pivot and move in a rearward direction as the animal torso moves toward an upward position, and such that the simulated hind legs pivot and move in a forward direction as the animal torso moves toward a downward position, thereby simulating an anatomical movement of a running animal.

* * * * *